US005634447A

United States Patent [19]

Rowells

[11] Patent Number: 5,634,447

[45] Date of Patent: Jun. 3, 1997

[54] ELECTRONIC FUEL INJECTION AUGMENTATION OF AN ENGINE COMPRESSION BRAKE

[75] Inventor: Robert L. Rowells, Elmwood Park, Ill.

[73] Assignee: Navistar International Transportation Corp., Chicago, Ill.

[21] Appl. No.: 612,396

[22] Filed: Mar. 7, 1996

[51] Int. Cl.[6] ..... F02D 13/04; F01L 13/06

[52] U.S. Cl. ..... 123/322

[58] Field of Search ..... 123/320, 321, 123/322, 323, 324

[56] References Cited

U.S. PATENT DOCUMENTS

| | | | |
|---|---|---|---|
| 2,178,152 | 10/1939 | Walker | 123/324 |
| 3,023,870 | 3/1962 | Udelman | 123/321 |
| 3,220,392 | 11/1965 | Cummins | 123/321 |
| 4,658,781 | 4/1987 | Guinea | 123/320 |
| 4,741,307 | 5/1988 | Meneely | 123/321 |
| 4,848,289 | 7/1989 | Meneely | 123/320 |
| 4,932,372 | 6/1990 | Meneely | 123/321 |
| 4,945,870 | 8/1990 | Richeson | 123/90.11 |
| 5,012,778 | 5/1991 | Pitzi | 123/321 |
| 5,117,790 | 6/1992 | Clarke et al. | 123/321 |

*Primary Examiner*—Willis R. Wolfe
*Attorney, Agent, or Firm*—Dennis K. Sullivan

[57] ABSTRACT

An electronic fuel injection augmentation system and method for a turbocharged diesel engine compression braking system injects a predetermined volume of fuel into cylinders of an engine at a predetermined timing prior to the piston of the cylinder reaching a top dead center position. Combustion of such injected fuel increases cylinder pressure and engine braking. The increased pressure is transferred to the turbocharger of the engine thereby increasing intake air flow and engine braking as a result thereof.

18 Claims, 2 Drawing Sheets

ELECTRONIC FUEL INJECTION AUGMENTATION OF AN ENGINE COMPRESSION BRAKE

BACKGROUND OF THE INVENTION

The present invention relates to internal combustion engines, especially turbocharged diesel engines, and more particularly, to a system for electronic fuel injection augmentation of an engine compression brake and method for performing the operation wherein a small quantity of fuel is injected into the cylinders of an engine equipped with an electronically-controlled fuel injection system during the compression stroke but well in advance of top dead center, thereby raising cylinder pressure during compression and also increasing energy to the turbocharger, inherently increasing boost pressure. Upon increasing of boost pressure, braking power would increase a corresponding amount.

THE PRIOR ART

The Cummins U.S. Pat. No. 3,220,392 discloses a vehicle engine compression brake, including a fuel control system wherein fuel supplied to the engine cylinders is automatically shut off when braking or coasting, converting the engine into an air compressor.

Also, the Pitzi U.S. Pat. No. 5,012,778 discloses an externally driven compression release retarder for use on an engine equipped with an electronically-controlled hydraulic unit injector system. In this system, when the retarder is in operation, fuel supplied to the cylinder is shut off.

As will be described in greater detail, the system of the present invention differs from those previously proposed by adding, rather than restricting, fuel to greatly increased the braking potential.

SUMMARY OF THE INVENTION

Accordingly, it is a primary object of the invention to provide an internal combustion engine equipped with a compression brake with increased engine braking potential.

It is a further object of the invention to provide an improved compression braking system for use in an electronically-controlled fuel injection system which increases engine braking power.

These and other objects are specifically met by the compression braking system of the present invention wherein the electronically-controlled fuel injection system of a diesel engine operates to inject a small quantity of fuel into the cylinders of the engine well in advance of top dead center on the compression stroke, raising cylinder pressure during compression and increasing energy to the turbocharger, inherently increasing boost pressure and braking power. A conventional engine braking device opens the exhaust valve of the cylinder at about top dead center to relieve the compression in the cylinder.

BRIEF DESCRIPTION OF THE DRAWINGS

Other objects and advantages of the invention will become more apparent upon perusal of the detailed description thereof and upon inspection of the drawings in which.

DESCRIPTION OF THE PREFERRED EMBODIMENT

Figure 2:
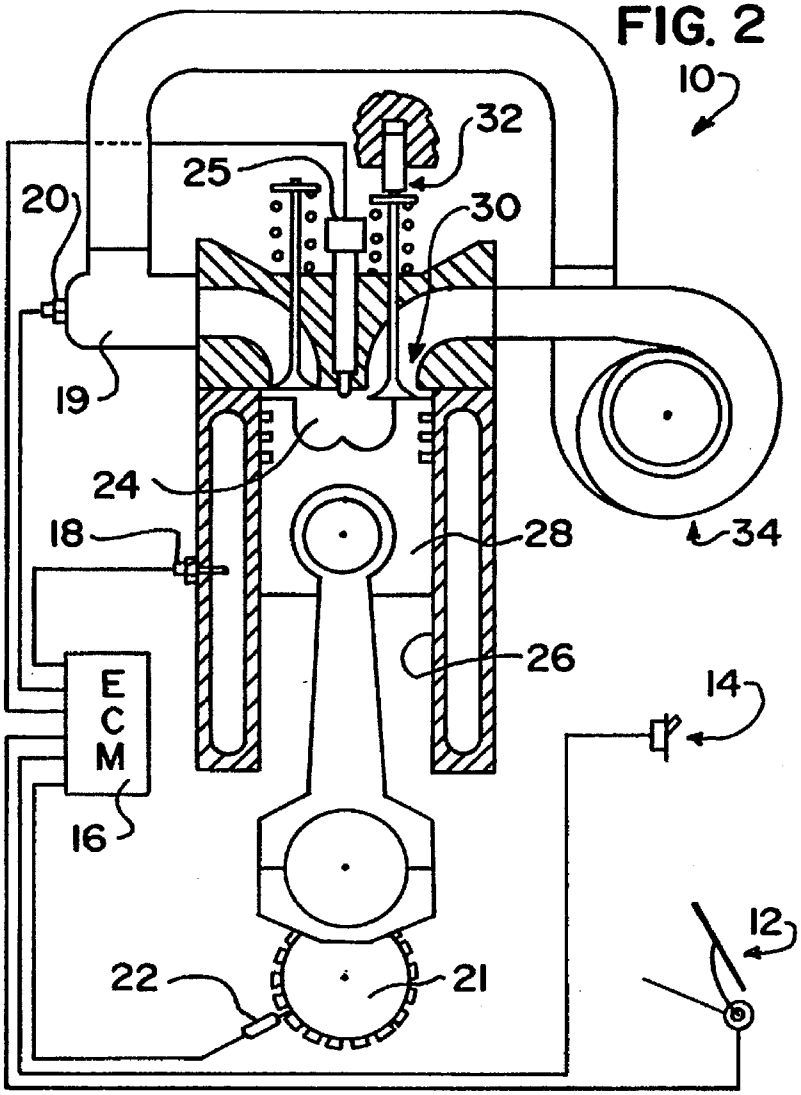
FIG. 2 illustrates the system of FIG. 1 with the piston at the top dead center position.
Figure 1:
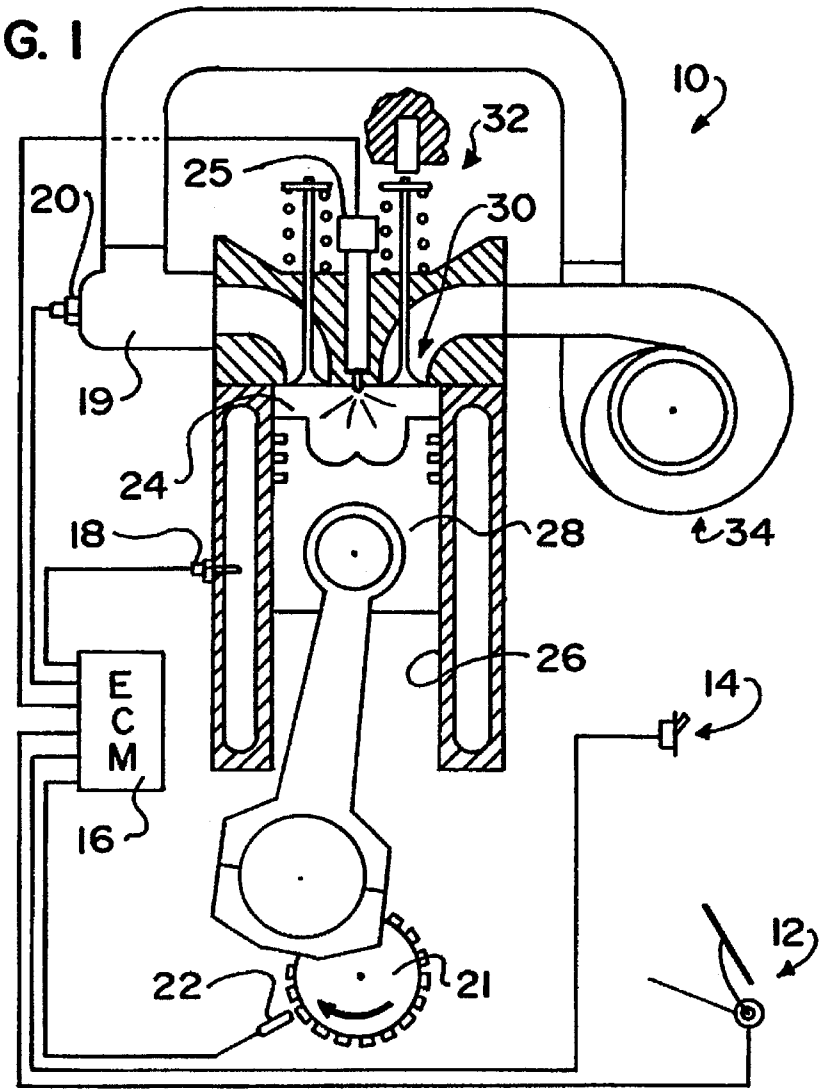
FIG. 1 is a schematic diagram of a turbocharged diesel engine equipped with a compression brake and the electronically controlled fuel injection system and illustrates an engine cylinder with the piston approaching a top dead center position and a shot of fuel being injected into the combustion chamber according to the teachings of the present invention.

Referring now to FIGS. 1 and 2 in greater detail, there is illustrated therein one of a plurality of cylinders 26 of an internal combustion engine, preferably a turbocharged diesel engine 10, equipped with an improved engine compression brake system in accordance with the invention. Each cylinder 26 has a reciprocating piston 28 therein which has at least a compression stroke wherein the piston is travelling upward in the cylinder 26 toward a cylinder head 29, a top dead center position wherein the piston is no longer travelling upward, and a power stroke wherein the piston is travelling downward in the cylinder.

The engine 10 is equipped with an electronic control module 16 which is a microprocessor programmed to control the operation of the engine fuel injection system in response to a plurality of sensors. More particularly, the engine 10 is provided with a hydraulically-operated, electronically-controlled unit injector fuel system of the type illustrated in U.S. Pat. No. 5,245,970, although any electronically-controlled fuel injection system could be used, and a conventional engine compression brake system, for example, the compression brake shown in Pitzi U.S. Pat. No. 5,012,778, both of these patents being incorporated herein by reference.

An accelerator pedal sensor switch 12 and a dashboard mounted compression brake enabling switch 14 are electrically connected to the electronic control module 16 as are a coolant temperature sensor 18, a pressure sensor 20 which senses the pressure in the intake manifold 19, and an engine speed sensor 22, which senses the speed of the crankshaft 21 and its rotational position. The electronic control module 16 is connected to a fuel injector 25 for the engine cylinder 26 and controls, in accordance with its programming, the timing and amount of fuel injected into the combustion chamber 24 defined between the reciprocating piston 28 and the cylinder head 29.

As is known in the compression brake art, a compression relief device 32, which may be a hydraulically-actuated piston whose operation is also controlled by the electronic control unit 14 through a hydraulic valve (not shown) as shown in the aforementioned Pitzi patent, is disposed to contact and open an exhaust valve 30 of the cylinder at or about the point when the piston 28 reaches its top dead center position at the beginning of the power stroke, provided that the accelerator pedal switch 12 senses an idle condition and the compression brake switch 14 is turned on. Activation of the compression relief device 32 may be also be accomplished through any one of several known methods.

As indicated above, the engine 10 is turbocharged in a conventional manner with a turbine end of turbocharger 34 being fluidly connected through exhaust valve 30 to the combustion chamber 24 and a compressor end of the turbocharger 34 being connected to the intake manifold 19.

In accordance with the invention, the electronic control unit 16 is further programmed to increase the braking power of the compression brake system. With the switch 14 activated and the accelerator pedal switch 12 sensing an idle condition of said engine (before the switch 14 is activated) so that no significant amount of fuel is injected into the cylinder during the power stroke, and the temperature of the engine coolant above a predetermined level, to prevent misfiring, the electronic control module 16 senses the pressure in intake manifold 19 and the engine crankshaft 21 speed and position and accesses empirically determined lookup tables stored in the memory of the electronic control module to establish the specific amount of fuel to be injected by the fuel injector 25 and the particular time for this injection event to occur. More specifically, the electronic control module commands the fuel injector to inject a small predefined quantity of fuel, based on the intake manifold pressure and engine speed, at a predetermined timing in advance of top dead center based on the engine speed such that combustion of the injected fuel occurs before the cylinder piston 28 reaches its top dead center position, as shown in FIG. 2, while the timing is not so early that the engine misfires. The increase in pressure within the combustion chamber 24 of the cylinder 26 created by combustion of the small amount of fuel before top dead center increases the braking power required to compress the excess combustion pressure created.

At or about the point when the piston 28 reaches its top dead center position, the exhaust valve 30 is opened by the conventional compression relief device 32 and the energy of the compressed air plus the additional energy created by the pre-top dead center combustion is routed to the turbocharger 34 which in turn further compresses the intake air.

Figure 3:
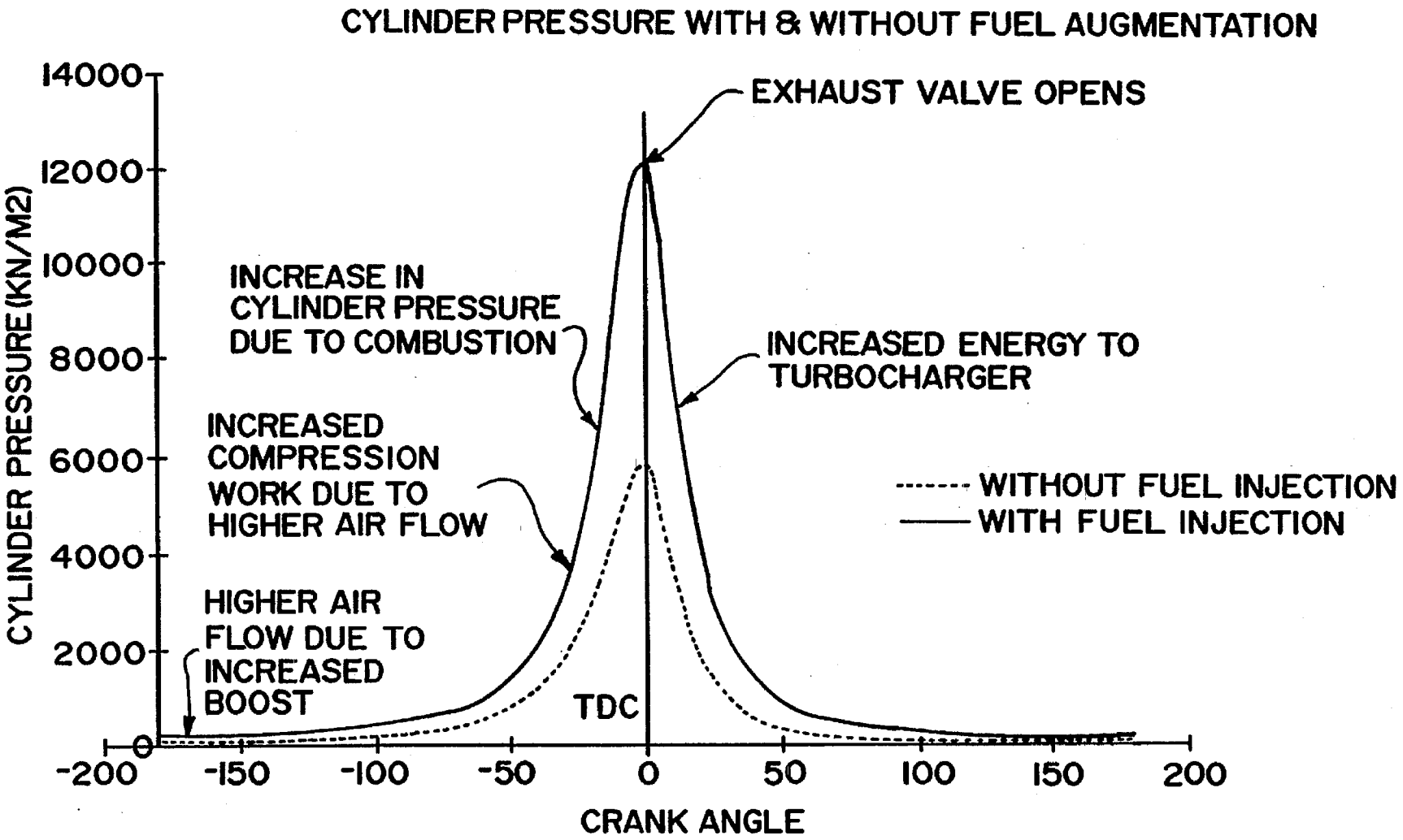
FIG. 3 is a graph comparing useable engine braking cylinder pressure with and without the invention.

FIG. 3 shows the methodology of the system 10 in graph form, and shows a significant increase in cylinder compression brake pressure which may be produced by the addition of the pre-top-dead-center combustion of the present invention. The addition of the small quantity of fuel as described above should not only increase the cylinder pressure due to its combustion but also increase the engine's air flow by transferring the energy of combustion to the turbocharger 34. This increased air flow will result in an increase in compression work, increasing braking power.

As described above, the invention provides a number of advantages, some of which have been described above and others of which are inherent in the invention. It will be evident to those of ordinary skill of the art in view of the foregoing description that various modifications may be proposed to the embodiment described without departing from the inventive teaching herein. Accordingly the scope of the invention should only be limited as necessitated by the accompanying claims.

What is claimed is:

1. In an internal combustion engine of the type having a reciprocating piston having a compression stroke, a top dead center position, and a power stroke, a programmed electronic control module, an electronically-controlled fuel injection system associated with and operated by said electronic control module, an engine compression brake, and selective means for activating and deactivating said engine compression brake, the improvement wherein said means for activating and deactivating said engine compression brake is operatively associated with said engine control module, and upon said engine compression brake being activated, said electronic control module is causes a quantity of fuel to be injected by said fuel injection system into a combustion chamber of said engine during the compression stroke of said piston.

2. The improved internal combustion engine of claim 1 wherein said engine is a diesel engine.

3. The improved internal combustion engine of claim 2 wherein said engine is turbocharged.

4. The improved internal combustion engine of claim 1 further comprising:

an intake manifold pressure sensor operatively engaged to said engine control module;

a transducer operatively engaged to said engine control module to indicate engine speed and crankshaft position;

said engine control module being programmed to determine a quantity of fuel to inject based on manifold pressure and engine speed and to determine the timing before the piston reaches top dead center position at which the fuel is to be injected based upon engine speed.

5. The improved internal combustion engine of claim 4 further including a coolant temperature sensor operatively engaged with said engine control module, said electronic control module being programmed to permit said quantity of fuel to be injected only upon said coolant temperature exceeding a predetermined level.

6. The improved internal combustion engine of claim 4 further including an accelerator pedal sensor switch operatively engaged with said engine control module, said electronic control module being programmed to permit said quantity of fuel to be injected only upon said accelerator pedal sensor sensing an idle position.

7. The improved internal combustion engine of claim 4 wherein said selective means for activating and deactivating said engine compression brake comprises a switch operatively engaged to said engine control module for turning the compression brake on and off.

8. In an engine compression braking system for a turbocharged diesel engine having an electronically-controlled fuel injector, the improvement comprising means for sensing position of a crankshaft of the engine and causing an injection of a predetermined small amount of fuel into each engine cylinder prior to a piston in the cylinder reaching a top dead center position on a compression stroke thereby increasing the power required to move the piston to said top dead center position and increasing engine braking.

9. The system of claim 8 further including means for sensing engine speed and intake manifold pressure, said small amount of fuel being predetermined based on sensed engine speed and sensed manifold pressure.

10. The system of claim 9 wherein the system further establishes a particular timing for said injection based on sensed engine speed such that combustion of said small amount of fuel is completed prior to said piston reaching said top dead center position.

11. The system of claim 8 further comprising compression relief means disposed to open a cylinder exhaust valve during the power stroke of said engine at or after the piston reaches said top dead center position.

12. The system of claim 8 operating under control of an electronic engine control module.

13. The system of claim 12 wherein said control module activates said system only when an engine accelerator pedal switch senses an idle condition thereof, when a system activating switch is engaged on, and when coolant temperature is determined to be above a predefined lower limit.

14. The system of claim 13 wherein a lookup table is provided within the module for determining the quantity of fuel to be injected based on sensed intake manifold pressure and engine speed.

15. The system of claim 13 wherein a lookup table is provided within the module for determining timing of the injection from sensed engine RPM.

16. A method for augmenting engine compression braking in a turbocharged diesel engine having an electronically-controlled fuel injector under the control of an electronic engine control unit, the method comprising the steps of:

sensing engine speed;

sensing engine crankshaft position;

sensing engine intake manifold pressure;

accessing a lookup table in said electronic engine control unit of predetermined fuel injection quantities for various levels of engine speed and intake manifold pressure and selecting a fuel quantity based on the sensed values;

accessing a lookup table in said electronic engine control unit of injection timings before top dead center on a piston compression stroke based on engine speed which will permit said selected quantity of fuel to be completely combusted in the cylinder before the piston reached top dead center and selecting an injection timing based on the sensed engine speed;

causing by said engine control module said fuel injector to inject said selected quantity of fuel at said selected timing; and opening an exhaust valve of the cylinder when the piston is at or after said top dead center position on a power stroke of said piston to relieve compression pressure.

17. The method according to claim 16 further including the step of:

feeding the additional energy created by combustion of said quantity to a turbocharger of the engine thereby creating increases in engine intake air flow and the power required to compress the intake air flow and thereby more braking power.

18. The method according to claim 17 further including the steps of:

sensing engine coolant temperature to be above a predefined level;

sensing an accelerator pedal sensor to be in an idle position; and selecting an "on" position of a selectively operable compression brake activation switch.

* * * * *